US005333484A

United States Patent [19]

Mine et al.

[11] Patent Number: 5,333,484

[45] Date of Patent: Aug. 2, 1994

[54] METHOD OF IRONING CYLINDRICAL WORKPIECE OF AUSTENITE STAINLESS STEEL, WITH CONTROLLED THICKNESS REDUCTION

[75] Inventors: Kohichi Mine, Aichi; Norio Itoh, Toyota, both of Japan

[73] Assignee: Toyota Jidosha Kabushiki Kaisha, Toyota, Japan

[21] Appl. No.: 942,162

[22] Filed: Sep. 2, 1992

[30] Foreign Application Priority Data

Sep. 4, 1991 [JP] Japan ..... 3-252949

[51] Int. Cl.[5] ..... B21D 22/28

[52] U.S. Cl. ..... 72/349; 72/379.4

[58] Field of Search ..... 72/349, 348, 347, 350, 72/379.4

[56] References Cited

U.S. PATENT DOCUMENTS

| | | | |
|---|---|---|---|
| 1,524,183 | 1/1925 | Knaebel . | |
| 1,638,995 | 8/1927 | Hodge . | |
| 2,611,475 | 9/1952 | Slater . | |
| 3,820,368 | 6/1974 | Fukuzuka et al. | 72/47 |
| 3,855,862 | 12/1974 | Moller | 72/349 |
| 4,217,770 | 8/1980 | Wassen | 72/349 |
| 4,457,150 | 7/1984 | Saunders et al. | 72/349 |
| 4,541,265 | 9/1985 | Dye et al. . | |
| 4,962,659 | 10/1990 | Imazu et al. | 72/349 |
| 5,179,854 | 1/1993 | Matsui et al. | 72/349 |

FOREIGN PATENT DOCUMENTS

| | | | |
|---|---|---|---|
| 0045115 | 2/1982 | European Pat. Off. | 72/349 |
| 0298560 | 1/1989 | European Pat. Off. | 72/349 |
| 0425704 | 8/1991 | European Pat. Off. . | |
| 2387706 | 12/1978 | France | 72/349 |
| 0045182 | 12/1978 | Japan | 72/349 |
| 57-11733 | 1/1982 | Japan . | |
| 59-29770 | 8/1984 | Japan . | |
| 60-3923 | 1/1985 | Japan . | |
| 63-264222 | 11/1988 | Japan . | |
| 547263 | 11/1975 | U.S.S.R. . | |

*Primary Examiner*—Daniel C. Crane

*Attorney, Agent, or Firm*—Finnegan, Henderson, Farabow, Garrett and Dunner

[57] ABSTRACT

A cylindrical workpiece prepared by drawing a sheet-like blank of austenite stainless steel is ironed in the axial direction in one step or in successive first and second steps. When the ironing operation is effected in one step, the wall thickness reduction percent is selected within a range of 35–45%. When the workpiece is ironed in the two steps, the first step is effected with the wall thickness reduction percent not exceeding 35%, while the second step is effected with the wall thickness reduction percent selected within a range of 35–45%.

7 Claims, 4 Drawing Sheets

FIG. 1
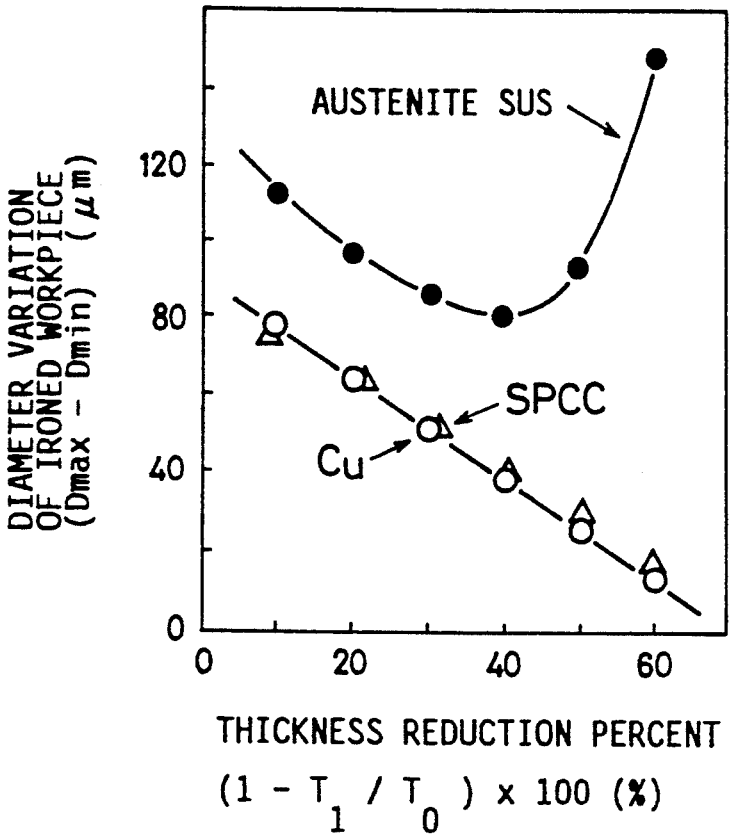
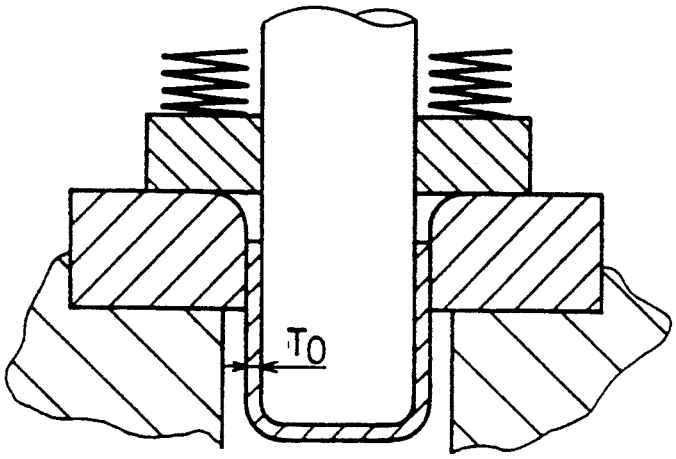
FIG. 2

METHOD OF IRONING CYLINDRICAL WORKPIECE OF AUSTENITE STAINLESS STEEL, WITH CONTROLLED THICKNESS REDUCTION

BACKGROUND OF THE INVENTION

1. Field of the Invention

The present invention relates to a method of ironing a cylindrical portion of a cylindrical workpiece formed of austenite stainless steel, and more particularly to such an ironing method which permits improved accuracy of outside and inside diameters of the ironed cylindrical portion.

2. Discussion of the Prior Art

A cylindrical portion of a cylindrical workpiece which has a bottom portion at one of the opposite axial ends of the cylindrical portion is ironed for improving the accuracy of the diametral dimensions (outside and inside diameters). The ironed cylindrical workpiece is used as a container, for example. This ironing process uses a punch, and a die which has a die hole formed therein so as to provide a land portion, which cooperates with the punch to effect an ironing operation. The punch is inserted into the cylindrical portion of the workpiece, through the open end of the cylindrical portion, until the end face of the punch is brought into abutting contact with the bottom portion of the workpiece. In this condition, the punch is moved with the workpiece into the die hole so that the wall thickness of the cylindrical portion is reduced, with the cylindrical wall squeezed between the moving punch and the land portion of the stationary die.

It is recognized that the accuracy of the diametral dimensions of the ironed cylindrical portion of the workpiece is improved with an increase in the wall thickness reduction ratio or percent of the cylindrical portion, when the workpiece is made of an ordinary material such as SPCC, copper and aluminum. The wall thickness reduction ratio means a ratio of the initial wall thickness of the cylindrical portion of the workpiece before ironing, to the wall thickness of the ironed cylindrical portion. The wall thickness reduction ratio or percent is determined so as to attain the desired accuracy of the diametral dimensions of the ironed workpiece.

For the workpiece made of austenite stainless steel, however, there is not a recognition in the art on the relationship between the wall thickness reduction percent and the accuracy of the diametral dimensions of the ironed workpiece. The present inventors found a problem with the prior art ironing process when applied to the cylindrical workpiece made of austenite stainless steel. This problem experienced in the prior art will be described by reference to the accompanying drawings.

BRIEF DESCRIPTION OF THE DRAWINGS

The above problem, and an object, features and advantages of the present invention will be understood by reading the following discussion of the prior art problem and detailed description of the invention, when considered in connection with the accompanying drawings, in which:

FIG. 1 is a graph showing a relationship between wall thickness reduction percent and diameter variations of ironed austenite stainless steel workpiece, in comparison with those of ironed SPCC and Cu workpieces;

FIG. 2 is a fragmentary front elevational view in cross section of an apparatus for drawing a cylindrical workpiece before the workpiece is ironed with the wall thickness reduction percent as indicated in FIG. 1;

PROBLEM SOLVED BY THE INVENTION

An extensive study by the inventors on ironing operations on cylindrical austenite stainless steel workpieces revealed a relationship between the wall thickness reduction percent of the workpiece and the diametral accuracy of the ironed workpiece, as shown in the graph of FIG. 1, wherein the diameter variation (Dmax−Dmin) of the ironed workpiece is taken along the vertical axis, while the wall .thickness reduction percent $(1-T_1/T_0)\times 100$ is taken along the horizontal axis. The graph shows that the diameter variation decreases with an increase in the wall thickness reduction percent, for the workpieces made of SPCC and copper (Cu), namely, the accuracy of the diametral dimensions of the ironed workpiece is improved as the wall thickness reduction percent increases. For the workpiece made of austenite stainless steel (SUS), on the other hand, the diameter variation of the ironed workpiece is minimum when the wall thickness reduction percent is approximately 40% and increases as the wall thickness reduction percent decreases and increases from approximately 40%.

Figure 3:
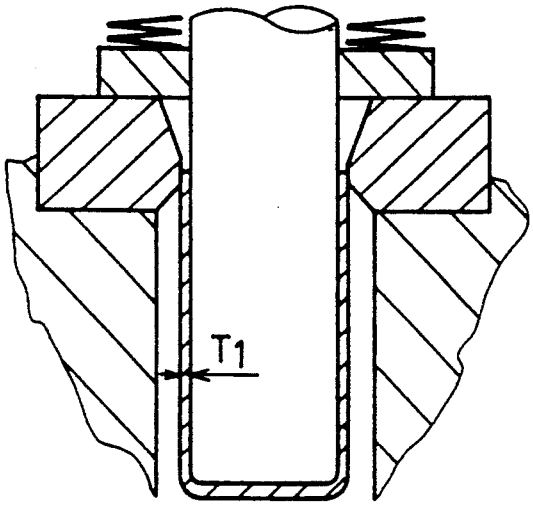
FIG. 3 is a fragmentary front elevational view in cross section of an apparatus for ironing the workpiece drawn by the apparatus of FIG. 2.

FIG. 2 shows a drawing apparatus for preparing a cylindrical workpiece by drawing a sheet-like blank. The cylindrical portion of the prepared workpiece has the wall thickness To as indicated in FIG. 2. The cylindrical wall of the workpiece is ironed by an ironing apparatus as shown in FIG. 3, in which $T_1$ represents the wall thickness of the ironed cylindrical wall. The wall thickness reduction percent is therefore represented by $(1-T_1/T_0)\times 100$, as indicated in FIG. 1. Further, the diameter variation is a difference between Dmax and Drain which are the largest and smallest ones of the diametral dimensions of the ironed cylindrical portion measured in various diametric directions. That is, the ironed cylindrical portion has a certain amount of "out of roundness" expressed as a difference between the maximum and minimum diametral dimensions Dmax and Dmin measured, for example, at the inner surface of the ironed cylindrical wall of the workpiece.

OBJECT OF THE INVENTION

It is accordingly an object of the present invention to provide a method of ironing a cylindrical portion of a cylindrical workpiece made of austenite stainless steel, which method permits a satisfactorily high degree of accuracy of the diametral dimensions of the ironed cylindrical portion.

SOLUTION TO THE PROBLEM

The above object may be achieved according to one aspect of the present invention, which provides a method of ironing a cylindrical portion of a cylindrical workpiece of austenite stainless steel, in an axial direction of the cylindrical portion, the method comprising an ironing operation wherein the cylindrical portion of the workpiece is ironed such that a wall thickness reduction percent $(1-T_1/T_0)\times 100$ of the cylindrical portion of the workpiece is selected within a range of 35–45%, where $T_0$ represents a wall thickness value of the cylindrical portion prior to the ironing operation while $T_1$ represents a wall thickness value of the cylindrical portion after the ironing operation.

The same object may also be achieved according to a second aspect of this invention, which provides a method of ironing a cylindrical portion of a cylindrical workpiece which is prepared by drawing a sheet-like blank of austenite stainless steel, the method comprising a first ironing step and a second ironing step following the first ironing step, for ironing the cylindrical portion of the workpiece in an axial direction thereof, such that a wall thickness reduction percent $(1-T_1/T_0)\times 100$ of the cylindrical portion in the first ironing step is selected to be less than 35%, and a wall thickness reduction percent $(1-T_2/T_1)\times 100$ of the cylindrical portion in the second ironing step is selected within a range of 35–45%, where $T_0$ represents a wall thickness value of the cylindrical portion prior to the first ironing step, while $T_1$ and $T_2$ represent wall thickness values of the cylindrical portion after the first and second ironing steps, respectively.

DETAILED DESCRIPTION OF THE INVENTION

The present invention was developed on the inventors' finding that the diameter variation of the ironed cylindrical portion of the workpiece made of austenite stainless steel changes with the wall thickness reduction percent of the cylindrical portion such that the diameter variation is the smallest when the wall thickness reduction percent is approximately 40% as shown in FIG. 1. According to the first aspect of this invention, the wall thickness reduction percent is selected within a range of 35–45% so that that the variation in the diametral dimensions of the ironed cylindrical portion is held to within a tolerable range.

Figure 4:
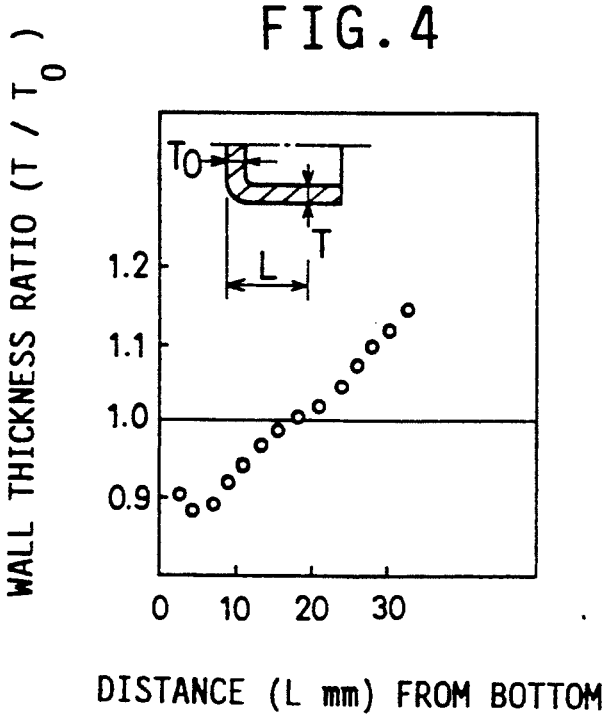
FIG. 4 is a graph showing wall thickness ratio of cylindrical and bottom portions of a cylindrical workpiece drawn from a circular austenite stainless steel plate, in relation to an axial distance from the bottom portion.
Figure 5:
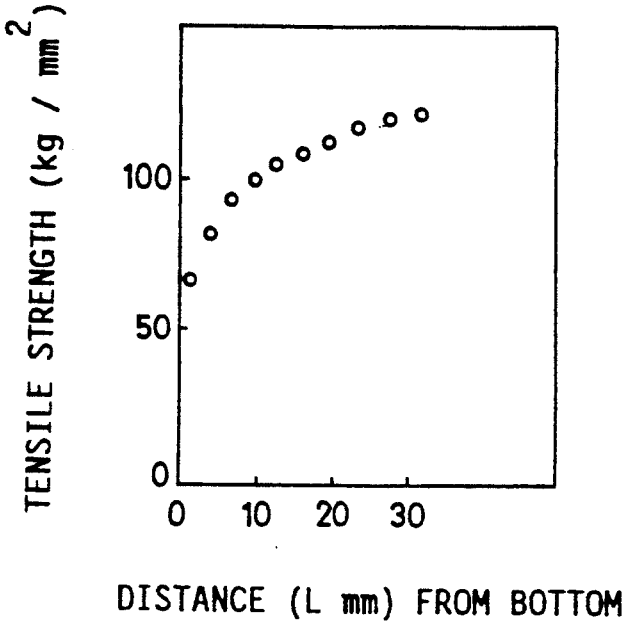
FIG. 5 is a graph showing a tensile strength of the drawn cylindrical workpiece of FIG. 4, in relation to the axial distance from the bottom portion.

When the cylindrical portion of the workpiece obtained by drawing from a sheet-like blank of austenite stainless steel is ironed in one step or in one ironing pass of the punch, the diameter variation of the ironed cylindrical portion cannot be reduced to less than 80 μm. This fact appears to relate to variations in the wall thickness ratio $(T/T_0)$ and tensile strength of the cylindrical workpiece before ironing, in the axial direction of the cylindrical portion, as a function of an axial distance L from the bottom portion. The wall thickness ratio $(T/T_0)$ is a ratio of the thickness T of the cylindrical portion to the thickness $T_0$ of the bottom portion of the non-ironed workpiece. FIG. 4 shows that the wall thickness ratio $(T/T_0)$ of the cylindrical and bottom portions of the workpiece increases with an increase in the axial distance L. FIG. 5 shows that the tensile strength of the cylindrical portion also increases with the axial distance L. When an ironing operation is performed on the cylindrical workpiece, therefore, an ironing force acting on the workpiece rapidly increases as the ironing operation progresses with the punch being moved relative to the die in the axial direction of the workpiece, whereby the amount of strain or elastic deformation of the die considerably changes in the axial direction, with the changing ironing force. As a result, a tensile stress is considerably large at the already ironed part of the cylindrical portion of the workpiece, which is adjacent to the leading end of the punch, and the leading part of the cylindrical portion adjacent to the bottom portion is elongated by a larger amount than the other part, and tends to have a thickness considerably smaller than the other part. This leads to deteriorated consistency of the diametral dimensions of the ironed cylindrical portion of the workpiece.

Where the diameter variation of the ironed cylindrical portion of the austenite stainless steel workpiece should be reduced to less than 80 μm, a machining or grinding operation on the ironed cylindrical portion of the workpiece is required to obtain a product having desired dimensional accuracy. This finishing operation inevitably results in an increase in the cost of manufacture of the product and a decrease in the production efficiency.

Figure 6:
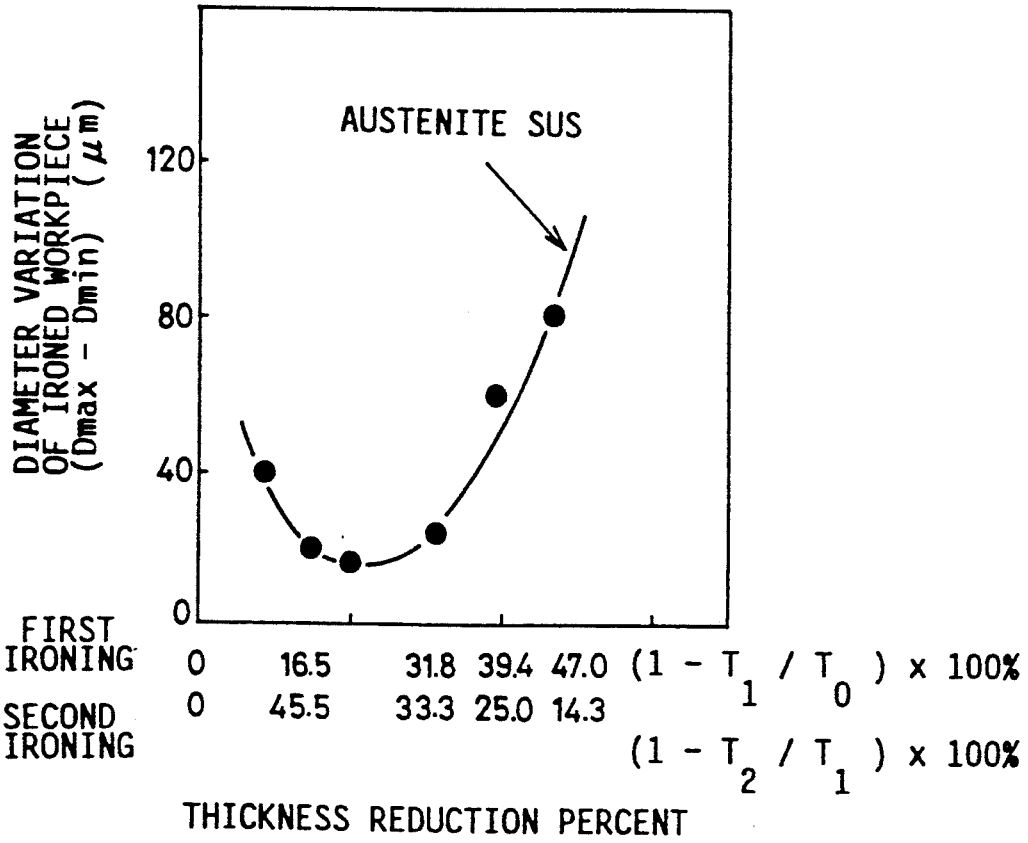
FIG. 6 is a graph showing a relationship between diameter variation of ironed cylindrical austenite stainless steel workpiece, and a combination of wall thickness reduction percent values in two ironing steps on the workpiece.

A further research by the present inventors indicated that it was possible to reduce the diameter variation of the ironed workpiece to less than 80 μm, if the cylindrical workpiece prepared by drawing from a sheet-like blank of austenite stainless steel is ironed in two steps with suitably controlled wall thickness reduction percent values in these ironing steps. Experiments were conducted on many specimen workpieces, with various combinations of wall thickness reduction percent values $(1-T_1/T_0)\times 100$ used in the first ironing step and wall thickness reduction percent values $(1-T_2/T_1)\times 100$ used in the second ironing step. $T_0$ represents the thickness of the cylindrical portion of the drawn workpiece. The graph of FIG. 6 shows the results of the experiments, indicating the relationship between the diameter variation (Dmax−Dmin) and the thickness reduction percent. Thus, the inventors discovered that the diameter variation can be reduced to approximately 20 μm or smaller, if the wall thickness reduction percent in the first ironing step is selected in a range not exceeding 35%, and the wall thickness reduction percent in the following second ironing step is selected within a range between 35% and 45%.

According to the above arrangement, the variations in the wall thickness ratio $(T/T_0)$ and tensile strength of the drawn workpiece in its axial direction are reduced by the first ironing step. Since the workpiece thus subjected to the first ironing step or preliminary ironing operation for reducing the above variations is then subjected to the second ironing step, the accuracy of the outside and inside diameters of the cylindrical portion of the ironed workpiece (product) can be significantly improved.

As described above, the present invention is applicable to the ironing of a cylindrical portion of a cylindrical workpiece made of austenite stainless steel, and is effective to improve the accuracy of the diametral dimensions of the ironed cylindrical portion, by suitably controlling the wall thickness reduction percent, and thereby enhance the quality of the end product.

The second aspect of the present invention which assures particularly high dimensional accuracy of the ironed cylindrical portion of the workpiece totally or partially eliminates a machining, grinding or other finishing operation on the ironed workpiece, which is required according to the conventional ironing method, if the required dimensional accuracy of the ironed workpiece is relatively high. In this respect, it is noted that the amount of removal of the material from the ironed cylindrical portion of the workpiece by a machining operation is limited by the rigidity of the cylindrical portion sufficient to withstand a cutting resistance exerted thereto during the machining operation. In other words, such machining operation to finish the workpiece is not available where the thickness of the ironed cylindrical portion of the workpiece is relatively small. The ironing method according to the second aspect of the invention assures sufficiently high dimensional accuracy of the end product even when the thickness of the cylindrical portion of the workpiece is relatively small, for instance, as small as 0.3 mm or less.

EXAMPLE

Figure 7:
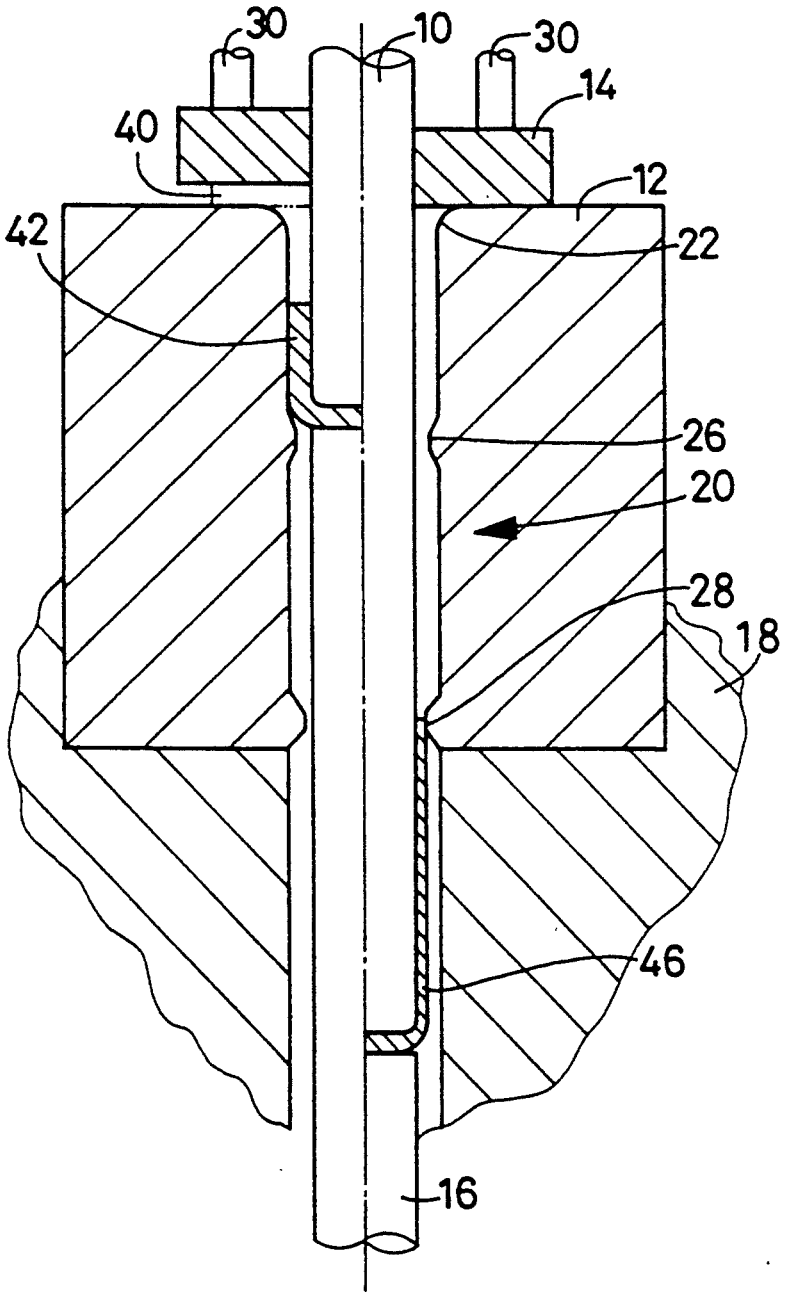
FIG. 7 is a front elevational view in cross section of a drawing and ironing apparatus used to practice an ironing operation according to one embodiment of this invention.

Referring next to FIG. 7, there will be described an ironing operation effected on a cylindrical workpiece which is prepared by drawing a sheet-like blank made of a austenite stainless steel material. The ironing operation is performed in two steps following a drawing operation, on a drawing and ironing apparatus illustrated in FIG. 7.

The drawing and ironing apparatus includes a punch 10, a die 12, a blank holder 14, and a knock-out rod 16. The punch 10 is fixed to a punch block moved by a ram, as well known in the art, and the die 12 is fixed to a stationary die block 18. The die 12 has a die hole 20 formed therethrough, so that the punch 10 is moved through the die hole 20. The die 12 has a drawing portion 22 near the upper open end of the die hole 20, and a first and a second ironing land 26, 28 which are formed on the inner surface of the die hole 20, so as to protrude in the radially inward direction. The first and second ironing lands 26, 28 are spaced from the drawing portion 22 and spaced apart from each other, in the direction of extension of the die hole 20. The blank holder 14 is biased by a plurality of rods 30, against the top face of the die 12.

To perform a drawing and ironing operation, a circular sheet-like blank 40 indicated in two-dot chain line in FIG. 7 is positioned on the top face of the die 12, so as to close the upper open end of the die hole 20. The blank 40 is forced by the blank holder 14 against the top face of the die 12.

In this condition, the punch 10 is inserted into the die hole 20, through a hole formed through the blank holder 14. As a result, a central portion of the circular blank 40 is drawn by a cooperative action of the punch 10 and the drawing portion 22 of the die 12. The drawing operation is completed when the leading or lower end of the punch 10 has reached a position some distance above the first ironing land 26 in the die hole 20. In FIG. 7, reference numeral 42 denotes a cylindrical workpiece prepared by drawing the blank 40 as described above.

The punch 10 is then further advanced or lowered with its lead end face contacting the bottom portion of the cylindrical workpiece 42, so that the cylindrical portion of the workpiece 42 is subjected to a first ironing operation, while being squeezed between the punch 10 and the first ironing land 26, when the workpiece 42 is moved past the first ironing land 26. As a result of this first ironing step, the variations in the wall thickness ratio ($T/T_0$) of the cylindrical and bottom portions of the workpiece 40 and the tensile strength of the cylindrical portion of the workpiece 42 in the axial direction of the workpiece 42 are reduced or mitigated, whereby the wall thickness ratio ($T/T_0$) and the tensile strength of the workpiece 42 are made uniform in the axial direction.

The workpiece 42 thus subjected to the first ironing operation is then subjected to a second ironing step, with a further advancing movement of the punch 10 relative to the die 12. In this second ironing step, the workpiece 42 is squeezed between the punch 10 and the second ironing land 28 while the workpiece 42 is moved past the second ironing land 28. The thus ironed workpiece, which is indicated at 46 in FIG. 7, has a high degree of consistency in the outside and inside diameters of the ironed cylindrical portion in the axial direction. In other words, the obtained product 46 has a sufficiently high degree of accuracy of the diametral dimensions.

Various specimens of the workpiece 42 were ironed in two steps as explained above, such that the wall thickness reduction percent in the first ironing step was selected within a range of 16–30%, while the wall thickness reduction percent in the second ironing step was selected within a range of 35–45%. The inspection of the obtained products 46 showed 20 μm or smaller variation in the diameter of the cylindrical portion, which does not require a machining, grinding or any other finishing process. Thus, the products 46 were obtained at a reduced cost, and with improved production efficiency.

The accuracy of the diametral dimensions of the product obtained according to the conventional ironing method cannot be improved by a machining operation, if the wall thickness of the cylindrical portion of the product is 0.3 mm or less. The present ironing method permits significantly improved dimensional accuracy of the product, even if the wall thickness of the cylindrical portion is 0.3 mm or less.

The present ironing method is also suitably used for producing an annular guide member which is fitted on an inner moving component in the form of a sleeve or cylindrical rod, for guiding the inner moving component. That is, the guide member can be made of austenite stainless steel having non-magnetic property, with a sufficiently reduced cylindrical wall thickness so as to assure increased magnetic permeability and thereby improve the operating response of the inner moving component. For instance, the annular guide member may be suitably used in a solenoid-operated valve, in which the guide member is disposed between an outer coil winding and an inner moving magnetic core, so that the guide member slidably engages the inner magnetic core to guide it in the axial direction.

While the present invention has been described above by reference to the accompanying drawings, it is to be understood that the invention is not limited to the details of the above description, but may be embodied with various changes, modifications and improvements, which may occur to those skilled in the art, in the light of the foregoing teaching, without departing from the scope of the invention defined in the following claims.

What is claimed is:

1. A method of minimizing diametral variation in wall thickness as a result of ironing a cylindrical portion of an austenite stainless steel workpiece, comprising the steps of, providing a workpiece of austenite stainless steel having a cylindrical portion of a first thickness; and ironing the cylindrical portion of the austenite stainless steel workpiece in an axial direction of the cylindrical portion to provide a cylindrical portion of a second thickness in a range of 35% to 45% less than the first thickness.

2. The method of claim 1 wherein the step of providing the workpiece of austenite stainless steel comprises drawing a sheet of austenite stainless steel to form the cylindrical portion of the workpiece.

3. The method of claim 1 wherein the step of executing the ironing step to provide a cylindrical portion of a second thickness, comprises providing a sleeve of a solenoid operated valve for positioning between an outer coil winding and an inner movable magnetic core to guide the magnetic core.

4. A method of minimizing diametral variation of a decreased wall thickness of a cylindrical portion of austenite stainless steel, comprising the steps of, drawing a sheet of austenite stainless steel to form the cylindrical portion having a first wall thickness;

executing a first ironing step to iron the cylindrical portion in an axial direction to reduce the first wall thickness by no more than 35% to obtain a second wall thickness;

executing a second ironing step to iron the cylindrical portion in an axial direction to reduce said second wall thickness to a third wall thickness in a range of 35 to 45% less than the second wall thickness.

5. The method of claim 4 wherein the step of executing the first ironing step includes reducing the first wall thickness in a range of between 16 to 30% of the first wall thickness to provide the second wall thickness.

6. The method of claim 4 wherein the step of drawing includes drawing the sheet to have a cylindrical portion with a wall thickness no greater than 0.3 mm.

7. The method of claim 4 wherein the step of executing the second ironing step comprises ironing a sleeve having the third wall thickness, the sleeve being a sleeve of a solenoid operated valve for positioning between an outer coil winding and an inner movable magnetic core to guide the magnetic core.

* * * * *